US007713109B2

(12) United States Patent
Estes

(10) Patent No.: US 7,713,109 B2
(45) Date of Patent: May 11, 2010

(54) QUICK-CHANGE GRINDING PAD AND MOUNTING SYSTEM

(76) Inventor: Michael Jack Estes, P.O. Box 562, Concrete, WA (US) 98237

( * ) Notice: Subject to any disclaimer, the term of this patent is extended or adjusted under 35 U.S.C. 154(b) by 1 day.

(21) Appl. No.: 12/016,981

(22) Filed: Jan. 18, 2008

(65) Prior Publication Data

US 2008/0176497 A1 Jul. 24, 2008

Related U.S. Application Data

(60) Provisional application No. 60/885,794, filed on Jan. 19, 2007.

(51) Int. Cl.
*B24B 23/00* (2006.01)

(52) U.S. Cl. ..... 451/56; 451/353

(58) Field of Classification Search ..... 451/548, 451/359, 57, 353, 542, 543, 56; 125/3
See application file for complete search history.

(56) References Cited

U.S. PATENT DOCUMENTS 2,111,955 A * 3/1938 Akans ..... 451/516
2,747,343 A * 5/1956 Gellert ..... 451/342
5,054,245 A * 10/1991 Coty ..... 451/353
5,567,503 A * 10/1996 Sexton et al. ..... 428/143
6,872,053 B2 * 3/2005 Bucher et al. ..... 416/210 R
7,147,548 B1 * 12/2006 Mehrabi ..... 451/323
7,192,339 B1 * 3/2007 Harding ..... 451/487
7,506,644 B2 * 3/2009 Park ..... 125/22
2008/0176498 A1 * 7/2008 Rossi et al. ..... 451/508
2009/0075573 A1 * 3/2009 Williams, Sr. ..... 451/353

* cited by examiner

*Primary Examiner*—Robert Rose
(74) *Attorney, Agent, or Firm*—Polly L. Oliver

(57) ABSTRACT

A quick change mounting system for grinding and other surface preparation pads provides a simple and effective way for the pads to be mounted and changed on the mounting plate of a large surface preparation machine without removing the mounting plate from the machine. (This method also allows that existing mounting plates and preparation pads may be used with a minimal amount of adaptation.) The new quick-change system makes use of a unique slot design (using countersunk keyhole slots) for mounting the pads on the plate. Studs fixed on the pads fit into slots on the plate and may lock into position. In operation, centrifugal and other forces then help to further seat the pad onto the plate.

8 Claims, 8 Drawing Sheets

QUICK-CHANGE GRINDING PAD AND MOUNTING SYSTEM

RELATED APPLICATIONS

This application is related to and claims priority under 35 U.S.C. 119(e) to U.S. provisional application Ser. No. 60/885,794 entitled "Quick-Change Grinding Pad and Mounting System," filed on Jan. 19, 2007, with inventor Michael Estes of Kent, Wash., which is hereby incorporated by reference in its entirety.

FIELD OF THE INVENTION

This invention pertains generally to surface preparation machinery and more specifically to a quick-change system for removably mounting surface preparation pads onto such machinery.

BACKGROUND OF THE FIELD

Grinding, polishing, finishing, and other type pads have long been used for various surface preparation tasks. This technology is typically employed on large machines, often rotary disk grinders, by fastening the grinding, polishing, or other pads to a mounting plate which in turn is fastened to the large machine (sometimes to a turntable on the large machine). Screws are typically used to fasten the pads to the mounting plate, and in order to avoid damaging the screws as the pads or inserts in the pads wear, those screws have been placed through the plate into the pad—with their screwheads on the machine side—hidden when mounted. Consequently, in order to replace worn out grinding pads or to accomplish changes in grit fineness for finishing, it is necessary to remove the entire mounting plate from the machine to get at the heads of the fastening screws for removal. This extra step adds time and complexity to the task of changing pads.

SUMMARY OF THE INVENTION

The present invention solves the above-mentioned problems by providing a simple and effective way for grinding, polishing, finishing, and other type pads to be mounted and changed on the mounting plate without removing the mounting plate from the machine. (This method also allows that existing mounting plates and preparation pads may be used with a minimal amount of adaptation.) The new quick-change system makes use of a unique keyhole slot design for mounting the pads on the plate. Studs fixed on the pads fit into slots (which may offer countersinks for further engagement) on the plate and may lock into position. In operation, centrifugal and other forces then help to further seat the pad onto the plate.

DETAILED DESCRIPTION OF THE PREFERRED EMBODIMENT

Figure 1A:
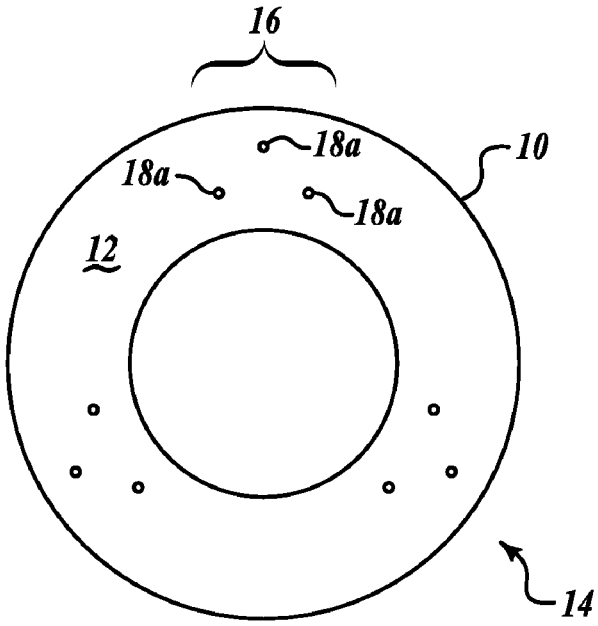
FIG.1A (PRIOR ART)
FIG. 1A is a front view showing the prior art of a mounting plate with three holes strategically placed at each installation station.
Figure 1B:
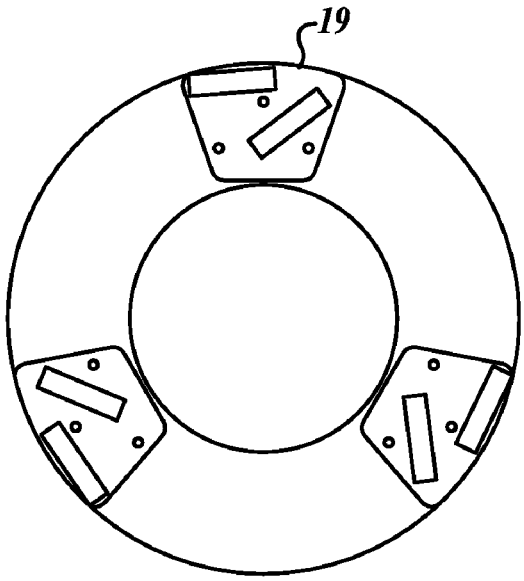
FIG.1B (PRIOR ART)
FIG. 1B is a front view showing the prior art of the plate with preparation pads mounted thereon.

FIGS. 1A and 1B show the prior art of a mounting plate 10 having a front side 12 and a back side 14 and having three holes bored therethrough at each installation station (pad-mounting station) 16 for mounting the preparation pads. In FIG. 1A is shown that the typical mounting plate 10 of the prior art is a ring (although it could be of any other convenient shape) and there are typically three installation stations 16. The number of installation stations, as well as the number of holes defined at each station, could vary from three, but three is the number for each that is typical in the industry and therefore has been chosen for illustration.

FIG. 1A shows the three holes 18*a*, 18*b*, and 18*c* at a typical installation station 16. The three holes may or may not be countersunk on the back side 14 (not shown). FIG. 1B shows a preparation pad 19—in this case a grinding pad with diamond inserts—as it is mounted on the mounting plate 10 using screws through the three holes. The screws have been installed from the back side 14 and into the preparation pad 19 so as to hold the preparation pad in place while performing surface grinding. This method of installing the preparation pads takes time because it requires the operator to first remove the mounting plate 10 from the machine, which may be a very cumbersome procedure depending on how the mounting plate is fastened to the machine. Obviously, changing preparation pads—e.g., from grinding to polishing, from polishing to finishing—is complicated and time consuming.

Figure 2A:
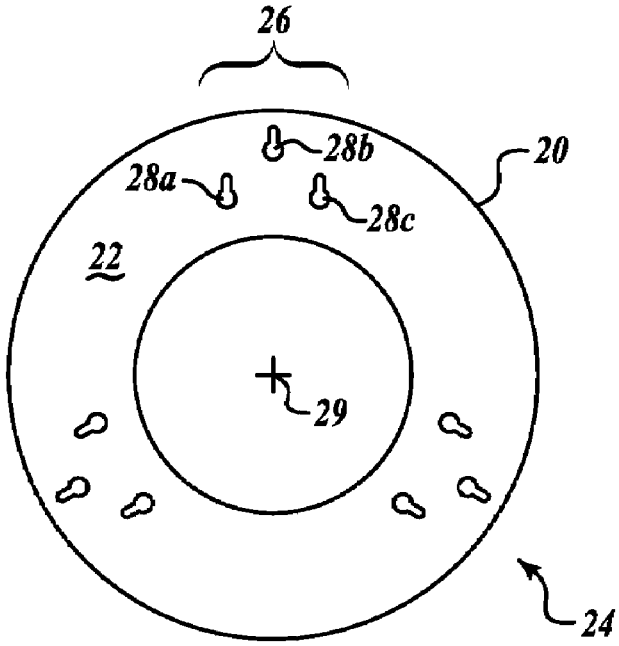
FIG. 2A is a front view of the mounting plate of the quick-change system showing a plate with three keyhole slots at each installation station.

FIG. 2A shows the preferred embodiment of a mounting plate 20 (which in the preferred embodiment is a generally circular ring) in the new quick-change system having a front side 22 and a back side 24. For this illustration, three installation stations 26 have been chosen—instead of a different number, but it is understood that there could be more or fewer than three installation stations, depending on machine design. Each installation station 26 defines three keyhole slots 28*a*, 28*b*, and 28*c* which are oriented generally radially and define both keyhole portions and slot portions. The keyhole slots have their keyhole portions oriented generally toward the geometric center 29 of the plate 20. Depending upon machine design, it may be desirable for the keyhole slots to be countersunk on the back side of the mounting plate so that the protruding studs of the preparation pads can fit snugly and flush with the mounting plate. The countersinks may be angled or squared (as shown in subsequent figures) to accommodate and mate with the protruding studs of the preparation pads.

Figure 2B:
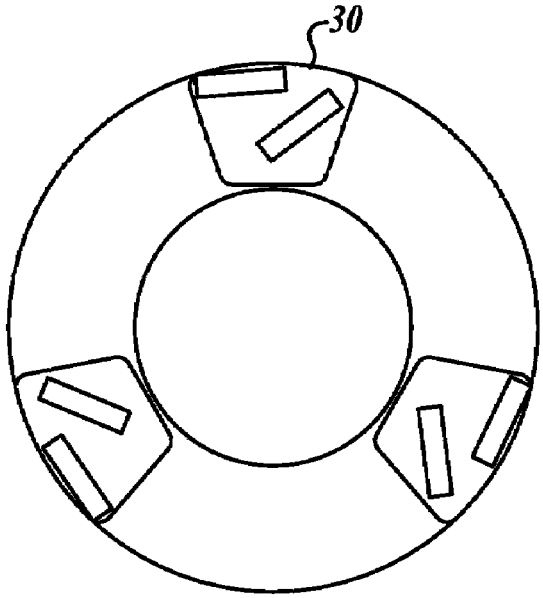
FIG. 2B is a front view of the mounting plate of the quick-change system showing preparation pads mounted thereon.

FIG. 2B shows a preparation pad 30 as it is to be installed on the mounting plate 20 using the quick-change system. Properly installed, the preparation pads will offer the same configuration as the prior art, but will be held in place by a combination of the keyhole slots and centrifugal forces—instead of by screws through the plate and into the pad. When properly installed, the preparation pad will fit snugly against the front side of the mounting plate. The quick-change system offers a simple way for the preparation pads 30 to be quickly and easily installed and removed by sliding the preparation pads into and out of the keyhole slots. The preparation pads themselves, as shown in FIGS. 5A-D, have protruding studs (at least one, but enough to correspond with the number of keyhole slots) which fit into the keyhole slots and may have countersunk heads to fit flush with the back side of the mounting plate 20. In the preferred embodiments, the protruding studs of the preparation pads will be integrally manufactured with the preparation pads, but in alternate embodiments, or retrofits, the studs may be simply screws or other fasteners that are inserted into the preparation pads.

Figure 3A:
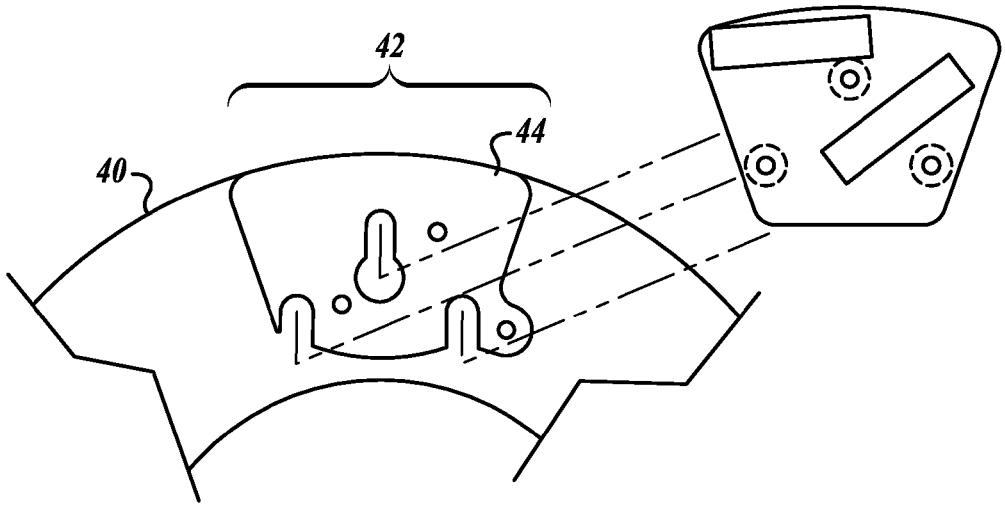
FIG. 3A is a front view of a plate section with the adapter pad installed.

In order to make use of the many existing mounting plates that have holes defined at their installation stations instead of slots (typically three holes at each of three installation stations), an adapter pad can be used to provide the necessary slots for the quick-change system. FIG. 3A shows a section of a mounting plate 40, which is identical to the prior art mounting plate with holes instead of slots at the installation station 42, with an adapter pad 44 installed thereon. The adapter pad 44 makes use of the existing holes (typically bored completely through the mounting plate in the triangular pattern shown) in the mounting plate 40 and is installed in the same way as a prior art preparation pad, i.e., by screwing into the mounting plate (the screws being inserted from the back side through the three holes) into the adapter pad itself for a permanent attachment. Once the adapter pad 44 is installed, the installation station 42 now offers three slots for the mounting of a preparation pad, the slots being oriented generally radially. For this retrofit, only one slot is a complete keyhole slot, as will be explained later. The keyhole slot, as in the preferred embodiment, has its keyhole oriented toward the geometric center.

Figure 3B:
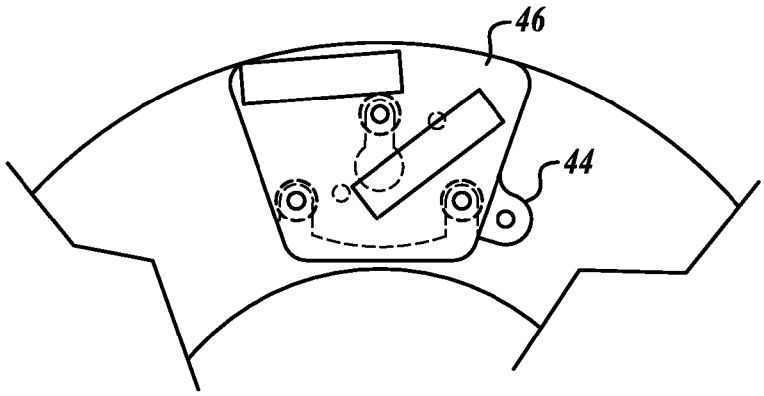
FIG. 3B is a front view of a plate section with an adapter pad and preparation pad installed.
Figure 3C:
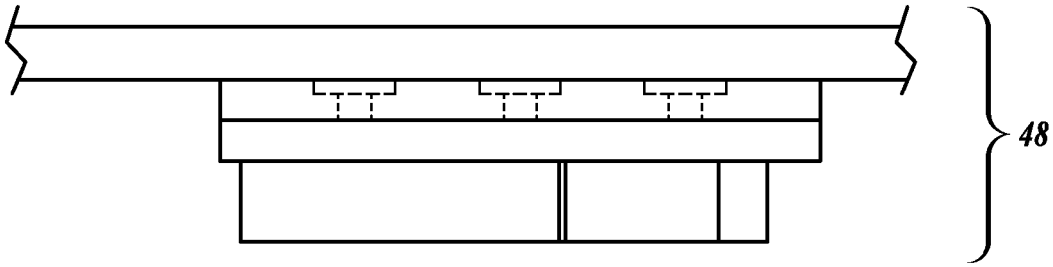
FIG. 3C is a side view of a plate section with an adapter pad and a preparation pad installed.
Figure 4B:
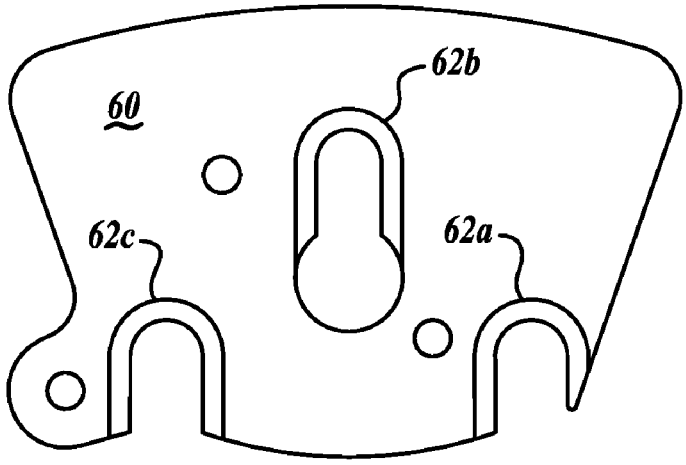
FIG. 4B is a back view of an adapter pad showing the countersinks.
Figure 5A:
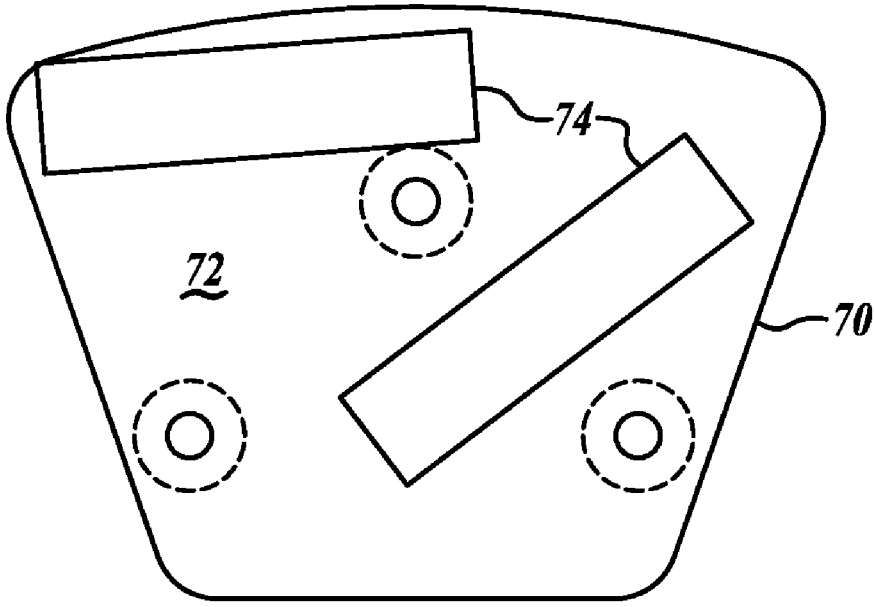
FIG. 5A is a front view of a typical grinding pad.
Figure 5B:
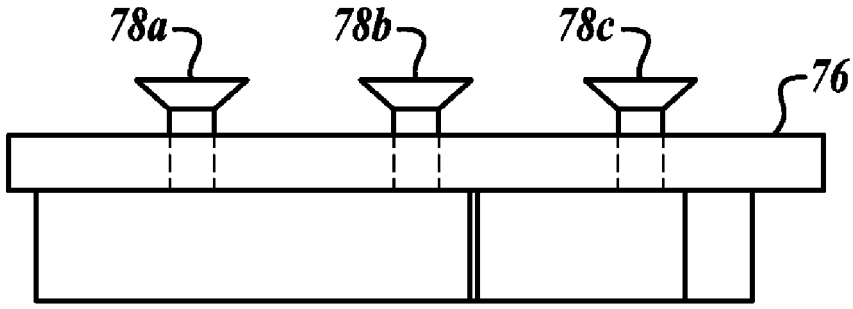
FIG. 5B is a side view of a typical grinding pad.

FIG. 3B shows how a preparation pad 46 is to be mounted into the keyhole slots of the adapter pad 44. FIG. 3C shows the same assembly from the side. The increased thickness 48 of the assembly is usually not a problem because it simply raises the height of the overall machine from the surface (often a floor) by a small (perhaps even negligible or unnoticed) amount. FIG. 3C shows that the slots in the adapter pad (and the corresponding studs on the preparation pad) may be countersunk on the back side of the adapter pad with squared (or angled) countersinks to help seat the studs in the slots. Countersinks (as shown in FIGS. 4B and 5B) may facilitate insertion and removal but are not necessary for the invention. With this system, it is not necessary to remove the mounting plate from the machine; the operator simply slides the preparation pad into and out of the slots of the adapter pad.

Figure 4A:
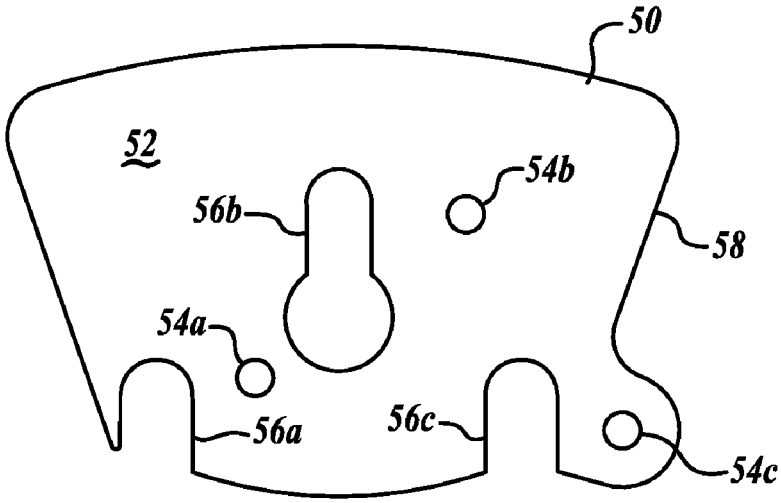
FIG. 4A is a front view of an adapter pad.

The adapter pad 50 is shown in detail in FIG. 4A. On the front side 52 are shown the three screw holes 54*a*, 54*b*, and 54*c* which are used to permanently attach the adapter pad 50 to the mounting plate. Different types of fasteners besides the screws as shown could be used to attach the adapter pad to the mounting plate, including other mechanical fasteners, adhesives and the like, but the screws and screw holes shown and defined here have been chosen for the preferred embodiment because they make the adapter pad attachable to the existing mounting plates using existing hardware.

In addition, the front side 52 of the adapter pad 50 shows the three slots 56*a*, 56*b*, and 56*c* defined in the adapter pad for temporarily mounting the preparation pad. Because the adapter pad is ideally configured to take advantage of existing preparation pads, only one keyhole slot is completely defined, i.e., the other two present only the slot portion and not the keyhole portion, as shown at 56*a* and 56*c*. However, it is important for at least one of the slots, here slot 56*b* to be defined completely so as to at least partially trap the preparation pad used (preventing unintended loss of parts).

The overall two-dimensional shape of the adapter pad 50 as defined by the perimeter edge 58 is somewhat arbitrary and is chosen simply to optimize design for strength, material, and cost. The two-dimensional shape could be more regular, such as rectangular, ovate, etc, or could be any other appropriate irregular shape—as long as it accommodates the necessary screw holes and slots. The screwholes must be located so as to align with the existing screwholes at the installation station on the mounting plate, and the slots must be configured so as to accommodate the existing screws/studs on the preparation pads. FIG. 4B shows the countersinks 62*a*, 62*b*, and 62*c* (which may be squared or angled to mate with the screws or studs used on the preparation pad) on the slots 56*a*, 56*b*, and 56*c* on the back side 60 of the adapter pad. The countersinks are generally provided on the slot portions and not on the keyhole portions.

Various types of preparation pads may be used or adapted to be used with this quick-change system. For the embodiments shown here, typical grinding pads and polishing pads are illustrated. FIGS. 5A and 5B show front and side views respectively of a typical grinding pad 70. The front side 72 of the pad defines diamond inserts 74 in a usual configuration, and the back side 76 shows the three generally perpendicular protruding studs 78*a*, 78*b*, and 78*c* which are designed to fit into the keyhole slots and be mounted removably therein. The studs 78*a*, 78*b*, and 78*c* typically have countersunk heads (which in this view are angled, but may also be provided as squared) to engage with the countersinks 62*a*, 62*b*, and 62*c* on the mating slots in the adapter pad, and they may also be simply screws that have been inserted into the existing screw holes, if any. (In this embodiment, because it is an adaptation of an existing pad, the screwholes can be seen in FIG. 5A, and indeed the studs are formed by installing screws into the holes; however, in alternate embodiments, the pads may be integrally constructed with the studs thereon, so that the screwholes would not be present.) In such a modification of existing pads that already have screwholes, "off the shelf" precision shim washers may be used along with a high temperature thread locking compound to assure that the heads of the screws are installed and remain at the correct height (spacing from the pad surface) creating the mating studs to engage the slots properly so as to snugly fit therein. In alternative embodiments, the studs may be manufactured integrally with the pads so that there are no screwholes. To modify an existing mounting plate that already has screwholes, the screwholes will be machined out and formed into the appropriate slots with keyholes and countersinks, if necessary.

Figure 5C:
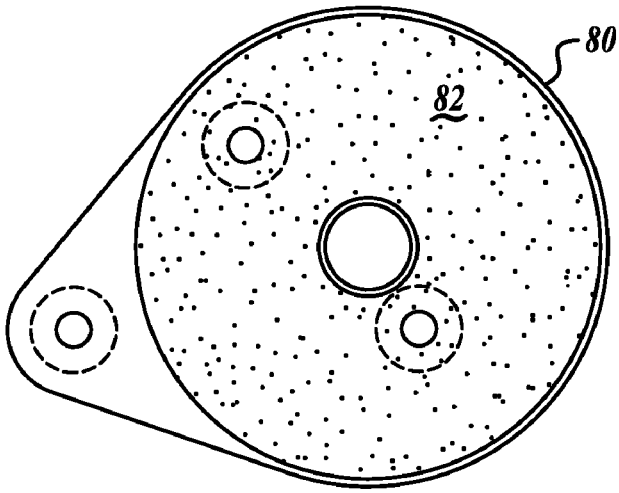
FIG. 5C is a front view of a typical polishing pad.
Figure 5D:
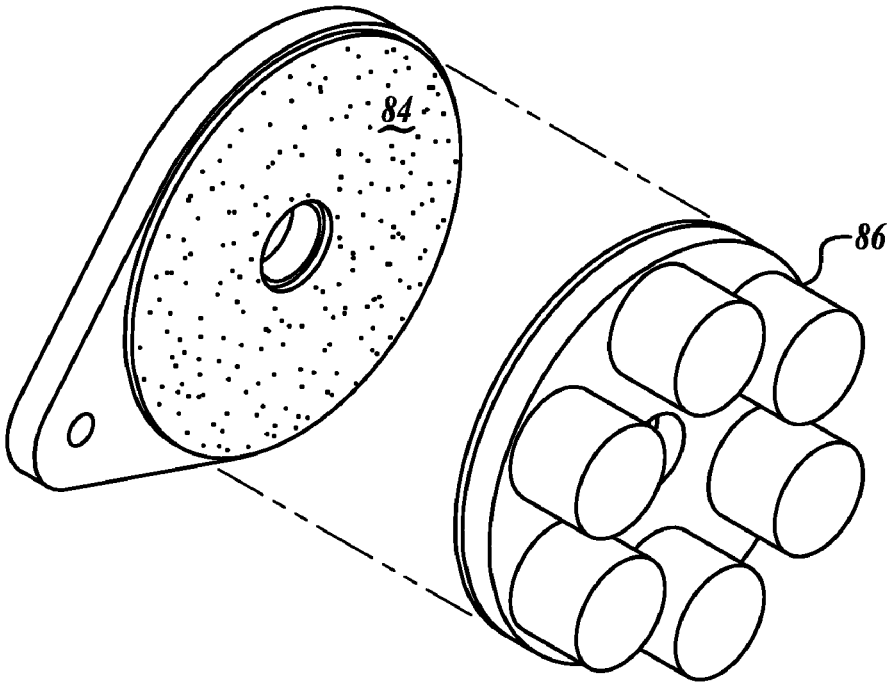
FIG. 5D is a perspective view of an alternate embodiment of a polishing pad.

FIG. 5C shows a front view of a polishing pad 80. For this pad, the appropriate polishing grit is used and applied to the pad as shown at 82. Alternatively, as is often used in the industry today shown in FIG. 5D, the polishing pad may be provided as two portions, where the first portion is removably attached to the mounting ring as discussed using the keyhole slots and the second portion is removably attached to the first portion using a temporary means for attaching. In FIG. 5D, one possible alternate is shown where the first portion is covered with one part of a hook-and-loop fastener 84 to which will fasten the mating part of the hook-and-loop fastener that is permanently attached to the separate polishing headpiece (second portion) 86. (Obviously, although hook-and-loop fasteners have been chosen here as the temporary means for attaching, any other appropriate fastener could be used.) This design further facilitates changing the polishing grit when necessary.

Figure 6:
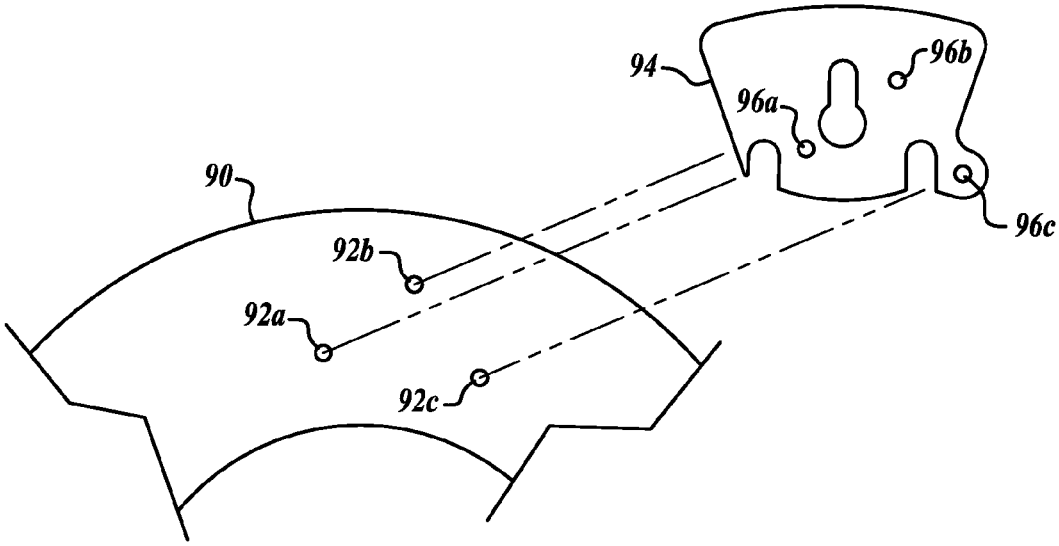
FIG. 6 is an exploded view of a plate with holes (prior art) and the adapter pad as it is to be installed.
Figure 7:
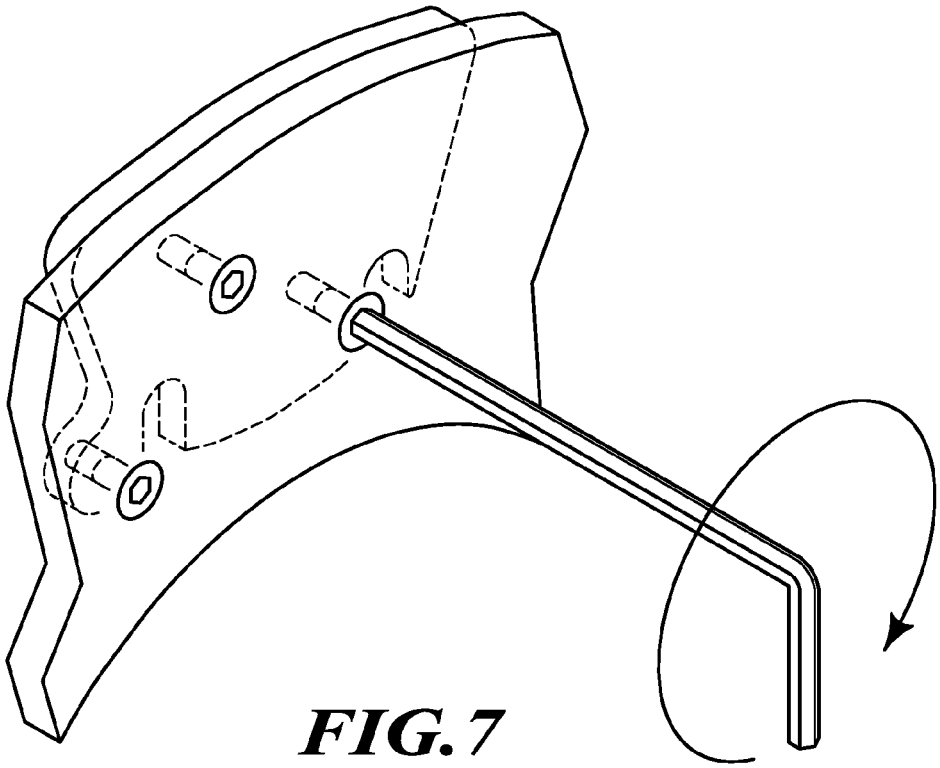
FIG. 7 is a back view of a plate with holes showing how the adapter pad may installed with Allen-type screws.
Figure 8:
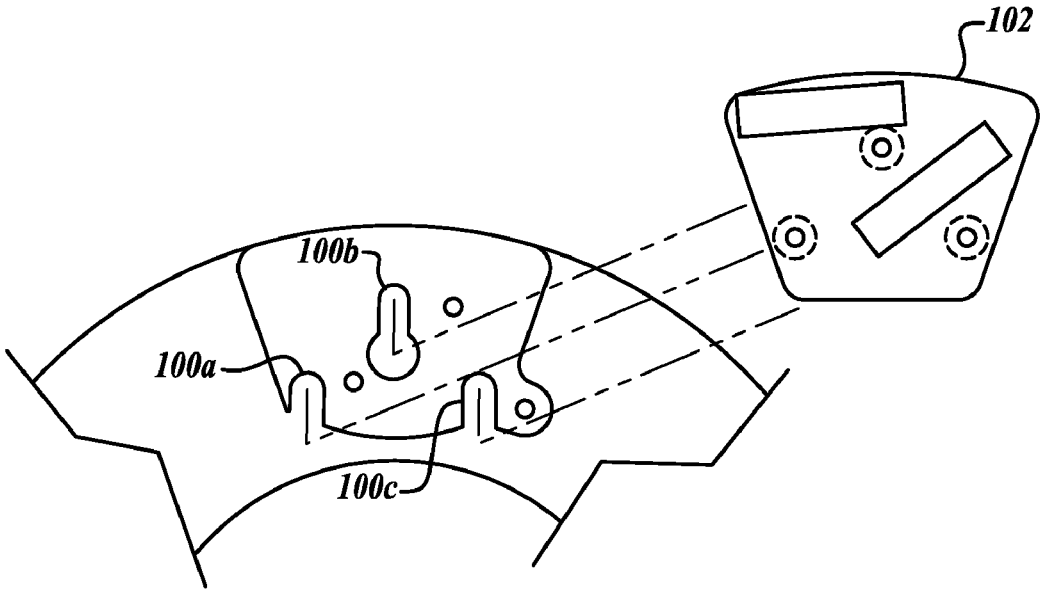
FIG. 8 is an exploded view of a plate with holes (prior art) with the adapter pad installed showing the preparation pad to be mounted.

FIG. 6 shows a prior art mounting plate 90 according to the usual industry standards, i.e., with three holes 92*a*, 92*b*, and 92*c* configured as shown. The adapter pad 94 is positioned to be applied to the mounting plate such that the three holes 96*a*, 96*b*, and 96*c* will be aligned with the corresponding holes in the mounting plate. Once the holes are aligned, screws will be inserted from the back side of the mounting plate as shown in FIG. 7 through the holes 92*a*, 92*b*, and 92*c* in the mounting plate and tightened into the holes 96*a*, 96*b*, and 96*c* in the adapter pad to permanently attach the adapter pad to the mounting plate. As shown here, the screws may be adapted for a hexhead Allen-type wrench, and the screw heads may be countersunk so as to fit flush with the mounting plate. Alternatively, the screws could be adapted for a different kind of wrench or screwdriver, or the screws could be replaced entirely with a different kind of appropriate fastener. Once thus permanently attached, the adapter pad 94 will not need to be removed from the mounting plate 90 while the preparation pads are changed. FIG. 8 then shows how the slots 100*a*, 100*b*, and 100*c* will be oriented to accept the studs from a preparation pad 102, so that the preparation pad can be simply slid onto the adapter pad. Of course, if the mounting pad has slots directly therein, there is no need for an adapter pad, and the preparation pad will be installed directly onto the mounting plate. In either set of circumstances (whether the slots are in the mounting plate itself or the slots are in an adapter pad permanently affixed to the mounting plate), the steps in the rest of this paragraph apply. After selecting the appropriate preparation pad according to the surface preparation task to be performed, a worker installs the preparation pad on the mounting plate by simply aligning the studs of the preparation pad with the slots in the mounting plate (at least one protruding stud with one keyhole slot) and inserting by pushing and sliding the studs into the slots and engaging them therein. The mounting plate is now ready for use with the appropriate pads mounted thereon. Such surface preparation machinery are often designed to spin, revolve, shuttle, or otherwise activate the mounting plates (on a rotary turntable) with the preparation pads thereon in order to abrade or rub the surface being prepared. In the preferred embodiments shown, the mounting plates are generally round rings or disks that will be rotated in operation, thereby generating centrifugal and other forces. As mentioned earlier, these centrifugal and other forces then further seat the protruding studs of the preparation pad more securely within the slots of the mounting plate during use. To replace the pad with a new or different one, the worker simply stops the machine and slides off the pad. The preparation pad is removed by pulling and sliding the studs from the slots; there is no need to remove the mounting plate from the machine.

What is claimed is:

1. A quick-change system for surface preparation equipment comprising: a mounting plate in the shape of a generally circular ring with a geometric center with a front side and a back side, said mounting plate having at least one installation station adapted for receiving a preparation pad, said at least one installation station consisting of at least one keyhole slot being oriented generally radially and being countersunk on the back side of said mounting plate with said keyhole oriented toward said geometric center, and said preparation pad having at least one protruding stud fitted into said at least one keyhole slot and having a countersunk head to mate therein, such that said preparation pad fits snugly against said front side of said mounting plate, said countersinks on said at least one keyhole slot and said at least one protruding stud being angled.

2. The quick-change system of claim 1 wherein said preparation pad is chosen from the group comprising grinding pads and polishing pads.

3. The quick-change system of claim 1 wherein said at least one protruding stud comprises a screw inserted into said preparation pad.

4. The quick-change system of claim 1 wherein said preparation pad is a polishing pad, and said polishing pad comprises a first portion to be removably attached to said mounting plate using said at least one keyhole slot and a second portion to be removably attached to said first portion using a temporary means for attaching.

5. The quick-change system of claim 4 wherein said temporary means for attaching comprises hook-and-loop fasteners.

6. The quick-change system of claim 1 wherein there are three installation stations spaced around said ring, and each installation station comprises three keyhole slots.

7. A method of temporarily installing a preparation pad onto a mounting plate of a surface preparation machine, said mounting plate comprising an adapter pad permanently affixed to a mounting ring, said adapter pad defining at least one angled and countersunk keyhole slot and said preparation pad comprising at least one angled and countersunk protruding stud designed to mate therein, said method comprising the steps of: selecting an appropriate preparation pad according to the surface preparation task to be performed; aligning the at least one protruding stud of the preparation pad with the keyhole slot of the mounting plate; inserting said protruding stud into said keyhole slot by pushing and sliding and engaging therein; and operating said surface preparation machine so that centrifugal force further seats said protruding stud of said preparation pad into said slot of said mounting plate.

8. The method of claim 7 further comprising the step of removing said preparation pad by pulling and sliding said at least one protruding stud from said at least one keyhole slot.

* * * * *